US007871197B2

(12) United States Patent
Wyssbrod

(10) Patent No.: US 7,871,197 B2
(45) Date of Patent: Jan. 18, 2011

(54) ZERO RESET DEVICE FOR TWO TIME COUNTERS

(75) Inventor: Baptist Wyssbrod, Nidau (CH)

(73) Assignees: Omega SA, Bienne (CH); Kazushi Takenaka

( * ) Notice: Subject to any disclaimer, the term of this patent is extended or adjusted under 35 U.S.C. 154(b) by 288 days.

(21) Appl. No.: 12/238,678

(22) Filed: Sep. 26, 2008

(65) Prior Publication Data

US 2009/0086583 A1 Apr. 2, 2009

(30) Foreign Application Priority Data

Oct. 2, 2007 (EP) ..... 07117757

(51) Int. Cl.
*G04F 7/00* (2006.01)

(52) U.S. Cl. ..... 368/106

(58) Field of Classification Search ..... 368/101–106, 368/112

See application file for complete search history.

(56) References Cited

U.S. PATENT DOCUMENTS 3,796,041 A * 3/1974 Boult ..... 368/103
3,901,020 A * 8/1975 Capt et al. ..... 368/105
3,927,519 A 12/1975 Berthoud
4,922,474 A * 5/1990 Groothuis ..... 368/113
5,793,708 A * 8/1998 Schmidt et al. ..... 368/106
6,761,478 B2 * 7/2004 Schmiedchen et al. ..... 368/101
7,331,706 B2 * 2/2008 Gabathuler et al. ..... 368/106

FOREIGN PATENT DOCUMENTS

CH 346170 6/1960
CH 5607/66 8/1968

OTHER PUBLICATIONS

European Search Report issued in corresponding application No. EP 07 11 7757, completed Jun. 18, 2008.

* cited by examiner

*Primary Examiner*—Vit W Miska
(74) *Attorney, Agent, or Firm*—Griffin & Szipl, P.C.

(57) ABSTRACT

Timepiece device for simultaneously resetting to zero two time counters, particularly for a chronograph mechanism, each of the two time counters pivoting about an arbour secured to a cam (6*b*, 8*b*), the simultaneous zero reset device (1) including a lever (4) with two hammers (6, 8), which are applied against the respective cams (6*b*, 8*b*) when the two time counters are reset to zero, at least one pin (10, 12) used to guide the lever (4) with two hammers (6, 8) being secured to said lever (4) and moving in a shaped aperture (24, 26) made in a bridge (28), characterized in that a ring (16*a*, 16*b*, 16*c*) is mounted to rotate freely about the pin (10, 12) and is inserted between said pin (10, 12) and the shaped aperture (24, 26) in which said pin moves.

7 Claims, 3 Drawing Sheets

ZERO RESET DEVICE FOR TWO TIME COUNTERS

This application claims priority from European Patent Application No. EP07117757 filed Oct. 2, 2007, the entire disclosure of which is incorporated herein by reference.

FIELD OF THE INVENTION

The invention concerns a device for simultaneously resetting two time counters to zero. The invention concerns in particular a zero reset device for two time counters of a chronograph mechanism, whose pivoting axes are secured to respective heart-shaped zero reset cams. This device includes in particular a lever with two hammers that strike the heart cams to rotate and return said heart cams to an angular position corresponding to zero on the counters.

BACKGROUND OF THE INVENTION

In order to reset to zero a counter such as a chronograph counter, a heart-shaped reset cam is associated with the arbour of the counter. This cam is associated with a hammer that has an impact surface which, when it abuts the symmetrical shoulders of the cam, enables the hammer to immobilise the heart cam in an angular position corresponding to zero on the counter. If, because of the working of the chronograph mechanism, the heart shaped cam is moved away from the angular position thereof corresponding to zero on the counter and the hammer strikes the cam, said cam will rotate via the effect of the force of the hammer and return to the angular position thereof corresponding to zero on the counter. In this position, the impact surface of the hammer abuts the two shoulders of the heart shaped cam and immobilises the cam.

A lever with two hammers is used for simultaneously resetting to zero two counters. Given the different tolerances, this device does not, in practice, enable the two impact surfaces of the hammers to abut simultaneously the respective shoulders of the two heart cams in the zero reset position of the two counters, such that the zero position of one of the counters is not defined precisely.

In order to take account of these tolerance problems, the lever with two hammers has been allowed a slight degree of pivoting freedom when it reaches the end of travel. It will be understood that allowing the lever to pivot slightly when the impact surfaces of its hammers are abutting against the respective shoulders of the two heart cams enables the hammer to adapt to a slight shift between said heart cams and to return said cams to the angular position thereof corresponding to zero on the counters. Nonetheless, when the lever pivots, this generates friction forces which are added to the resistant forces raised by the various elements of the chronograph mechanism that are set in action when the user presses on the control push button. Thus, the result of forces may be such that the action exerted by the user on the control push button becomes less than the reaction of the various mechanical elements that are set in operation via the effect of said action. The resulting situation is such that the action of the user has no effect and the counters are immobilised in an uncontrollable position. Consequently, anything that can help to decrease the reaction forces opposed by the chronograph mechanism when the latter is operated, must be examined.

Thus, it is more advantageous to try to reduce the friction forces that oppose the movement of the lever with two hammers.

SUMMARY OF THE INVENTION

It is an object of this invention to answer this and other objectives by providing a zero reset device for two time counters wherein the friction forces are reduced.

The invention therefore concerns a timepiece device for simultaneously resetting two counters to zero, particularly for a chronograph mechanism, each of the two time counters pivoting about an arbour secured to a cam, the simultaneous zero reset device including a lever with two hammers which are applied against the respective cams when the two time counters are reset to zero, at least one pin used for guiding the lever with two hammers being secured to the lever and moving in a shaped aperture made in a bridge, characterized in that a ring is mounted to rotate freely about the pin and is inserted between said pin and the shaped aperture in which said pin moves.

Owing to these features, the invention provides a device for simultaneously resetting two counters to zero wherein the lever with two hammers responsible for returning the counters to zero by acting on the corresponding cams opposes less resistance to the movement owing to the fact that, if the guide pin is forced against the edges of the shaped aperture in which it moves, said pin will roll, via the ring, against the edges and thus oppose less friction force. This proves particularly advantageous in the centring phase, when the pin reaches the bottom of the shaped aperture where it has a slight degree of freedom to pivot allowing the lever with two hammers to accommodate a slight shift between the heart cams and to return said cams to the angular position thereof that corresponds to zero on the counters. Indeed, if the moments, defined as being the product between the force exerted by the hammers on the respective heart cams at the point of contact between a hammer and the corresponding heart cam and the length of the line perpendicular to the line of action of said force driven from the pin (lever arm) are not equal, stresses appear which are exerted perpendicularly to the edges of the shaped hole in which the pin moves. Consequently, the presence of the ring, which rolls against the edges of the shaped aperture when the pin moves inside said aperture, limits the friction forces.

According to a complementary feature of the invention, the lever with two hammers is guided by two pins that are secured to said lever and that each move in a shaped aperture made in the bridge, one of said pins forming the pivoting coupling between said lever with two hammers and a control lever which the user acts upon to return the cams to an angular position corresponding to zero on the counters.

According to another feature of the invention, the pin via which the lever with two hammers is hinged to the control lever carries a ring, whereas the other pin carries two superposed rings, the lower of which plays the part of a spacer to compensate for the thickness of the control lever.

According to yet another feature of the invention, the ring is a machined part or a jewel.

According to yet another feature of the invention, the jewel is a ruby.

BRIEF DESCRIPTION OF THE DRAWINGS

Other features and advantages of the present invention will appear more clearly upon reading the following detailed description of an embodiment of the instantaneous zero reset device according to the invention, this example being given purely by way of non-limiting illustration with reference to the annexed drawing, in which.

DETAILED DESCRIPTION OF THE PREFERRED EMBODIMENTS

The present invention proceeds from the general inventive idea that consists in reducing the friction forces exerted on the two hammer lever of an instantaneous zero reset mechanism of a display device with two time counters for the dual purpose of limiting the reaction forces exerted by the mechanism following activation thereof to a lower value than the value of the action exerted by the user to switch on the mechanism, and to ensure that the force exerted by the impact surfaces of the hammers on the heart cams is perpendicular to the shoulders of the cams or, at least, is inscribed in a limited angular sector that ensures the cams are immobilised in a determined angular position corresponding to zero on the counters.

It will be clear that the present invention relates essentially to a new design of an instantaneous zero reset mechanism including a two hammer lever and that this mechanism may equally be used in a chronograph mechanism with two time counters or in any other time counter mechanism including two display devices (for minutes and seconds for example) that have to be reset to zero simultaneously using a control or zero reset lever.

It will also be clear that, although described with reference to a two-hammer lever, the present invention could equally apply to a mechanism including a lever with one hammer or three hammers.

Figure 1:
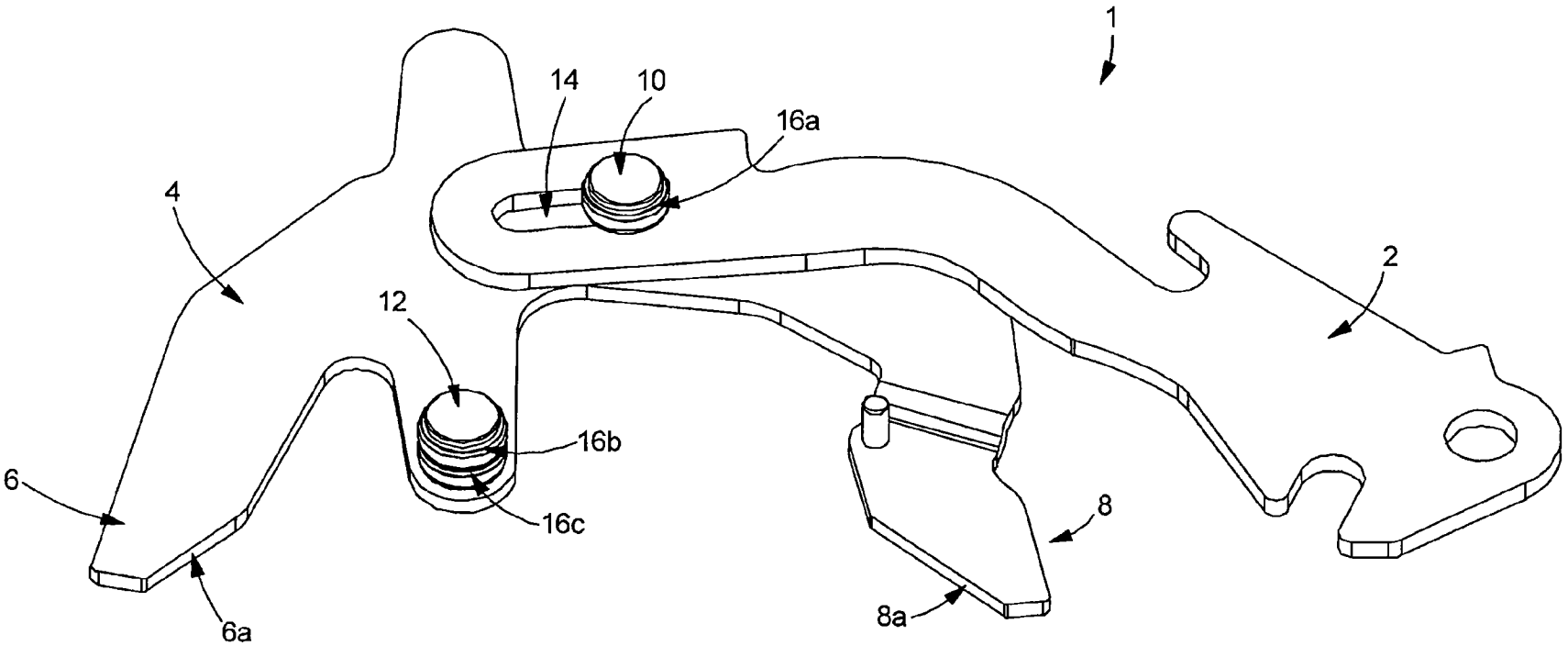
FIG. 1 is a perspective view of the lever with two hammers and the control lever of the instantaneous zero reset device according to the invention.

Designated as a whole by the general reference numeral 1, the instantaneous zero reset mechanism according to the invention is shown partially and in perspective in FIG. 1 annexed to the present application. This mechanism 1 essentially includes a zero reset lever 2 and a lever 4 including two hammers 6 and 8. These hammers 6 and 8 each have an inclined impact surface 6*a* and 8*a* via which they can immobilise two cams 6*b* and 8*b* (see FIG. 2) in a determined angular position corresponding to zero on the two time counters, one of which, designated by the reference numeral 7, is visible in FIG. 4.

As can be seen upon examining FIG. 1, lever 4 with two hammers 6 and 8 has two pins 10 and 12, which are secured to lever 4, for example by being driven or riveted therein. It will be noted that pin 10 is used for the pivoting articulation between lever 4 with two hammers 6 and 8 and zero reset lever 2. Thus, zero reset lever 2 has an oblong hole 14 in which pin 10 can slide. It will also be noted that a ring 16*a* is mounted to move freely on pin 10, whereas two superposed rings 16*b* and 16*c* are mounted to move freely on pin 12. Ring 16*c* plays the part of a spacer to compensate for the thickness of zero reset lever 2. Of course, spacers 16*b* and 16*b* could be made in one piece. Spacers 16*a*-16*c* may be machined metal parts or jewels. In the latter case, they made be made of rubies.

Figures 2, 3:
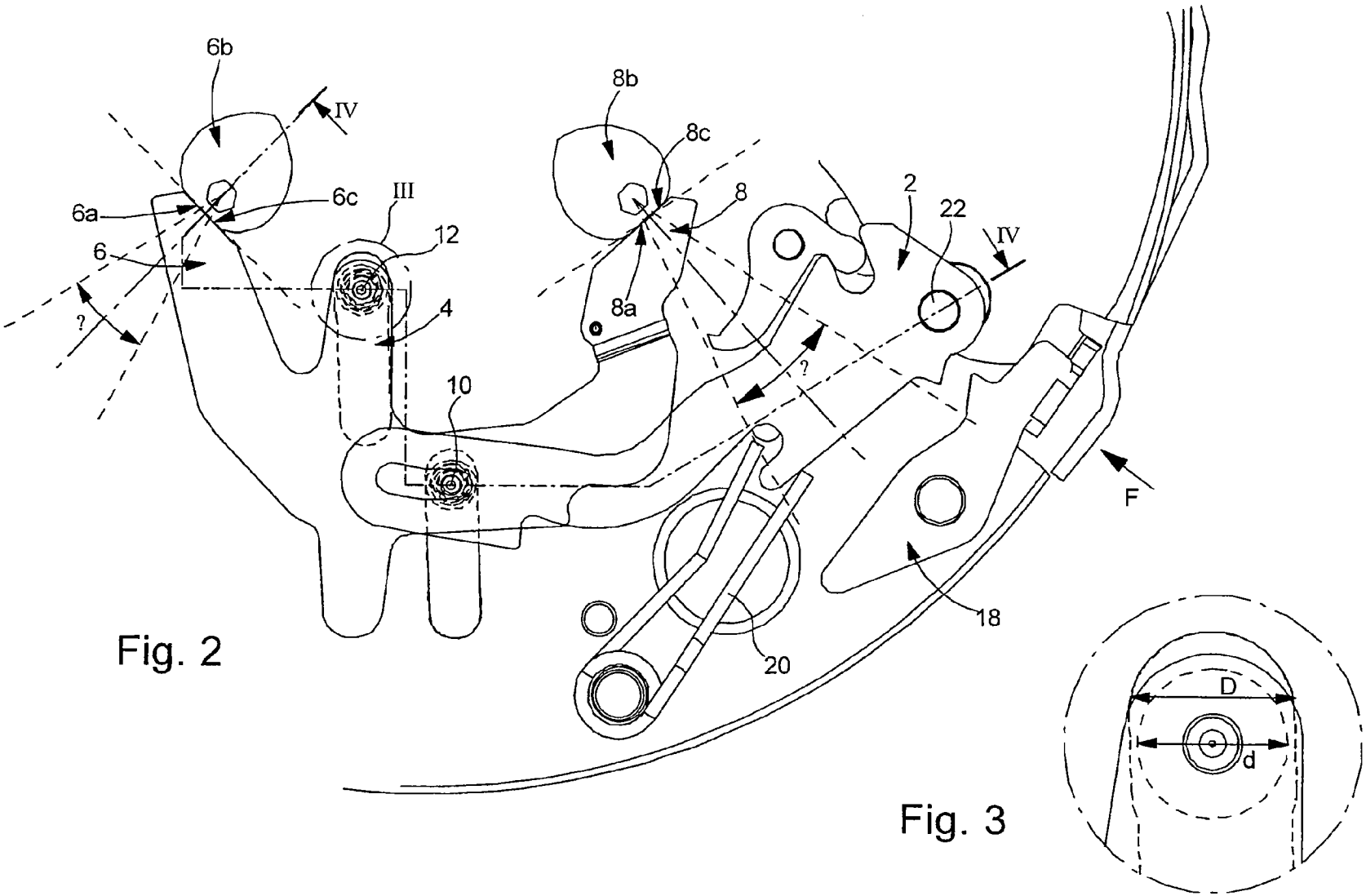
FIG. 2 is a plan view of the lever with two hammers and the control lever of FIG. 1 showing the cams whose angular position in the illustration corresponds to zero on the counters.
FIG. 3 is a larger scale view of the zone surrounded by a circle in FIG. 2.

In the situation shown in FIG. 2, lever 4 is in a position where the two hammers 6 and 8 are immobilising cams 6*b* and 8*b* in an angular position corresponding to zero on the time counters. More specifically, the impact faces 6*a* and 8*a* of hammers 6, 8 are abutting on the respective shoulders 6*c* and 8*c* of cams 6*b* and 8*b*.

Lever 4 with two hammers 6, 8, is brought into the position illustrated in FIG. 2 by the user pressing on a pusher (not shown) in the direction of arrow F. This pressure is transmitted to the zero reset lever 2 via a lever 18 against the return force of a spring 20. Under the effect of this pressure, zero reset lever 2 pivots about its arbour 22 in a clockwise direction and causes the lever 4 with two hammers 6, 8 to translate into the position shown in FIG. 2.

Figure 4:
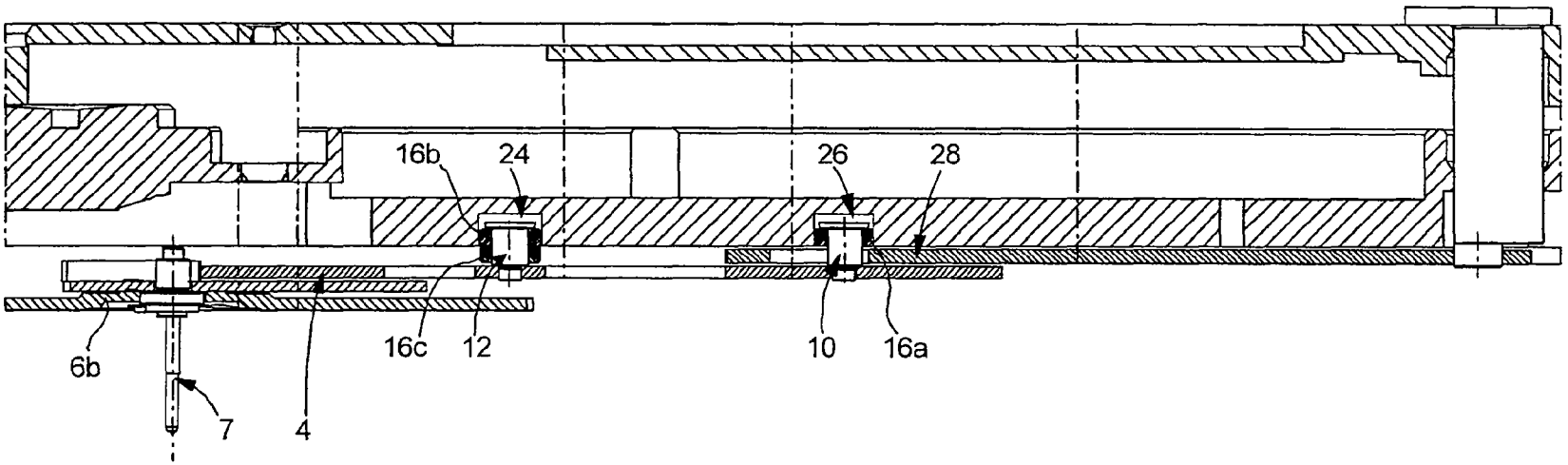
FIG. 4 is a cross-section along the line IV-IV of the instantaneous zero reset device according to the invention, shown in FIG. 2.

It will be noted that lever 4 with two hammers 6, 8 is guided in translation via its two pins 10, 12, which can move in two corresponding shaped holes 24 and 26 made in a bridge or plate 28 of the movement (see FIG. 4). Thus rings 16*a* and 16*b* are inserted between pins 10 and 12 and the edges of shaped holes 24 and 26 when pins 10, 12 move in holes 24, 26. Since rings 16*a*, 16*b* are free to rotate about pins 10, 12, the friction forces between said pins 10, 12 and the edges of shaped holes 24, 26 are significantly lessened. This prevents the reaction produced by the zero reset mechanism upon activation thereof from being greater than the action exerted by the user to activate the zero reset mechanism. If this condition is not satisfied, the action of the user is of no effect and the counters are immobilised in an uncontrollable position.

The fact of providing rings 16*a*, 16*b* that can move in rotation on pins 10, 12, which are used for guiding lever 4 with two hammers 6, 8 in translation is also very advantageous when pin 12 reaches the bottom of its shaped hole 26. Indeed, as can be seen in FIG. 3, the diameter D of shaped hole 26, at the end where pin 12 is located when lever 4 with two hammers 6, 8 is in the position in which it immobilises cams 6*b*, 8*b*, is slightly greater than diameter d of said pin 12, which enables lever 4 with two hammers 6, 8 to pivot slightly when it reaches the end of its travel and to accommodate a slight offset in cams 6*b*, 8*b* by returning said cams to their angular position corresponding to zero on the counters. Nonetheless, during this readjustment, forces perpendicular to the edges of shaped holes 24, 26 appear. In the absence of rings 16*a*, 16*b*, these forces would cause significant friction forces, which, on the one hand, could render the action of the user on the zero reset mechanism to start said mechanism ineffective. On the other hand, these friction forces would mean that the force exerted by the impact faces 6*a*, 8*a* on the respective shoulders 6*c*, 8*c* of cams 6*b* and 8*b* could not be guaranteed to be perpendicular relative to shoulders 6*c* and 8*c*, or at least not outside a limited angular sector $\alpha$ of the order of $\pm 15°$ relative to the normal to said shoulders 6*c*, 8*c* taken from the point of contact between said shoulders 6*c*, 8*c* and impact surfaces 6*a*, 8*a*.

It goes without saying that the present invention is not limited to the embodiments that have just been described and that various simple alterations and variants could be envisaged by those skilled in the art without departing from the scope of the invention defined by the annexed claims.

What is claimed is:

1. A timepiece device for simultaneously resetting to zero two time counters particularly for a chronograph mechanism each of said two time counters being pivoted about an arbour secured to a cam, the simultaneous zero reset device including a lever with two hammers which are applied against the respective cams when the two time counters are reset to zero, at least one pin being used to guide the lever with two hammers being secured to said lever and moving in a shaped aperture made in a bridge, wherein a ring is mounted to rotate freely about the pin and is inserted between said pin and the shaped aperture in which said pin moves.

2. The timepiece device according to claim 1, wherein the lever with two hammers is guided by two pins, which are secured to said lever and which each move in a shaped aperture made in the bridge, one of said pins forming the pivoting coupling between said lever with two hammers and a zero reset lever on which the user may act to return the cams to an angular position corresponding to zero on the counters.

3. The timepiece device according to claim 2, wherein the pin via which the lever with two hammers is hinged to the zero reset lever carries a ring, whereas the other pin carries two superposed rings the lower one of which plays the part of a spacer to compensate for the thickness of the zero reset lever.

4. The timepiece device according to claim 1, wherein the ring is a machined metal part or a jewel.

5. The timepiece device according to claim 2, wherein the ring is a machined metal part or a jewel.

6. The timepiece device according to claim 3, wherein the ring is a machined metal part or a jewel.

7. The timepiece device according to claim 4, wherein the jewel is a ruby.

* * * * *

UNITED STATES PATENT AND TRADEMARK OFFICE

CERTIFICATE OF CORRECTION

PATENT NO. : 7,871,197 B2
APPLICATION NO. : 12/238678
DATED : January 18, 2011
INVENTOR(S) : Wyssbrod It is certified that error appears in the above-identified patent and that said Letters Patent is hereby corrected as shown below:

On title page, Item (73) should read:

Assignees: Omega SA, Bienne (CH).

Signed and Sealed this
Twenty-second Day of November, 2011

David J. Kappos

David J. Kappos
*Director of the United States Patent and Trademark Office*